US006202955B1

(12) United States Patent
Self

(10) Patent No.: US 6,202,955 B1
(45) Date of Patent: Mar. 20, 2001

(54) METHOD AND APPARATUS FOR REWINDING

(76) Inventor: Timothy Self, Trinity Business Centre, South Street, Taunton, Somerset TA1 3AQ (GB)

( * ) Notice: Subject to any disclaimer, the term of this patent is extended or adjusted under 35 U.S.C. 154(b) by 0 days.

(21) Appl. No.: 09/351,818

(22) Filed: Jul. 13, 1999

(30) Foreign Application Priority Data

Jul. 13, 1998 (GB) ..... 9815016

(51) Int. Cl.[7] ..... B65H 75/24
(52) U.S. Cl. ..... 242/530.3; 242/571.1
(58) Field of Search ..... 242/530.3, 571.1, 242/571.2, 571.7, 576.1; 279/2.06, 2.07, 2.08, 2.09, 2.23

(56) References Cited

U.S. PATENT DOCUMENTS

| | | | | |
|---|---|---|---|---|
| 3,815,836 | * | 6/1974 | Munnekehoff et al. | 242/571.7 |
| 3,817,468 | * | 6/1974 | Smolderen et al. | 242/530.3 |
| 4,135,677 | | 1/1979 | Warczak . | |
| 4,175,712 | * | 11/1979 | Schippers et al. | 242/571.7 |
| 4,220,291 | * | 9/1980 | Papa | 242/530.3 |
| 4,496,114 | * | 1/1985 | Kataoka | 242/571.7 |
| 4,693,431 | * | 9/1987 | Kataoka | 242/571.2 |
| 5,971,314 | * | 10/1999 | Essert | 242/530.3 |

FOREIGN PATENT DOCUMENTS

| | | |
|---|---|---|
| 296 04 307 U | 1/1979 | (DE) . |
| 195 15 724 | 11/1996 | (DE) . |
| 0 866 017 A1 | 9/1998 | (EP) . |
| WO 95/14630 | 6/1995 | (WO) . |

OTHER PUBLICATIONS

Anwendungsspeizifische Spannelemente Fuer LWickel-wellen Papier + Kunststoff Verarbeiter vol. 31, No. 1, XP 000584425, dated Jan. 25, 1996.

* cited by examiner

*Primary Examiner*—John M. Jillions
(74) *Attorney, Agent, or Firm*—Melvin I. Stoltz

(57) ABSTRACT

A method of differential rewinding includes mounting a plurality of cores on a shaft (20) formed with a plurality of apertures (21) containing ceramic balls (23) urged outwardly into engagement with the cores by means of an inflatable sleeve (25).

5 Claims, 7 Drawing Sheets

PRIOR ART

METHOD AND APPARATUS FOR REWINDING

FIELD OF THE INVENTION

This invention relates to a method and apparatus for rewinding and is specifically concerned with differential rewinding.

The concept of differential rewinding has been in use for many years and is adopted to accommodate variations in tension or calliper across the web when rewinding material cut from a single roll onto a number of rewind coils.

Traditional methods of differential rewinding rely on the rewind cores slipping around a shaft which is being driven at a greater speed than the moving web of material. One arrangement for effecting differential rewinding is shown in FIG. 1 of the accompanying drawings.

In FIG. 1, a number of rewind cores 10 are mounted, either directly or via adaptors, on a rewind shaft 11 which is driven at a slight overspeed. Steel friction collars 12 keyed to the rewind shaft 11 are mounted on each side of each rewind core 10 or adaptor, and spacer cores 13 are positioned between adjacent rewind cores 10.

In operation, torque is transmitted to each of the rewind cores 10, which are free to rotate relative to the rewind shaft 11, such torque being transmitted frictionally through the steel driving collars 12 which are keyed to the rewind shaft 11 and are loaded axially against the cores 11 and 13 as indicated by the arrows in FIG. 1 by a pneumatic piston and cylinder mechanism. As the pneumatic pressure is increased, the frictional forces and the transmitted torque increases proportionally. This arrangement is such as to allow differential slip to occur permitting each individual strip to be rewound under optimum conditions to form a rewind roll 14.

More recent methods of providing differential rewinding have Involved the use of torque-responsive chucks on a keyed shaft and have improved the effectiveness of the differential system. The chucks each have a bronze bush in the centre with a low coefficient of friction and are assembled with mechanically expanded leaves that grip the cores.

The torque-responsive chuck arrangements eliminate the need to remove the spacers and the drive collars from the rewind shaft during reel removal. The chucks retract and release the cores allowing the finished reels to slide over the spacers. The shaft only requires dismantling when the slit pattern is changed to re-positon the chucks.

Although the use of torque-responsive chucks provides an improvement over the arrangement shown In FIG. 1, it does have a serious disadvantage in that it involves a reduction in the diameter of the rewind shaft to accommodate the chucks. This results in a dramatic reduction in strength.

The objects of the present invention thus Include the provision of an improved method of differential rewinding and the provision of an improved apparatus for differential rewinding which offer significant advantages over the known systems outlined above.

SUMMARY OF THE INVENTION

According to a first aspect of the present invention there is provided a method of differential rewinding which includes mounting a plurality of cores on a shaft formed with a plurality of apertures containing roller elements urged outwardly into engagement with the cores.

According to a second aspect of the invention there is provided a differential rewinding apparatus comprising a shaft on which, in use, a plurality of cores are mounted, a plurality of apertures in the shaft, roller elements in the apertures and means for urging the roller elements outwardly into engagement with the cores.

Each of the roller elements is preferably arranged to act between a core and a torque-transfer element formed of a material which has a coefficient of sliding friction with the roller elements lower than the coefficient of sliding friction between the roller elements and the cores. The roller elements will accordingly tend to roll relative to the cores.

The cores are preferably formed of cardboard or plastic and the roller elements are preferably ceramic balls, while the torque-transfer elements are preferably in the form of steel cups within which the ceramic balls are seated.

The means for urging the roller elements, i.e. the ceramic balls, into engagement with the cores preferably comprises an inflatable sleeve contained within the rewind shaft and so arranged that, when the pressure within the inflatable sleeve is increased, the torque transferred to the cores is increased.

The apertures in the rewind shaft are preferably arranged in the form of a multi-start helix so that, when cores of different widths are placed side-by-side on the rewind shaft, the number of roller elements which engage a particular core will depend on the width of the core Thus, as the width of a core is increased, the total torque transmitted to that core will be increased. It will thus be possible to rewind cores of different widths at the same time.

Means may be provided for preventing the accumulation of dust between the ceramic balls and the steel cups. Said means preferably comprises means for causing a flow of air out through the apertures in the rewind shaft.

The method and apparatus of the present invention are such that it is not necessary to fit spacers between adjacent cores. Any slit widths can accordingly be accommodated without resetting so that the present invention will enable the machine downtime to be decreased by up to 30% while improving the rewind shaft strength and achieving a dramatic increase in the reel quality.

DESCRIPTION OF THE PREFERRED EMBODIMENTS

Figure 1:
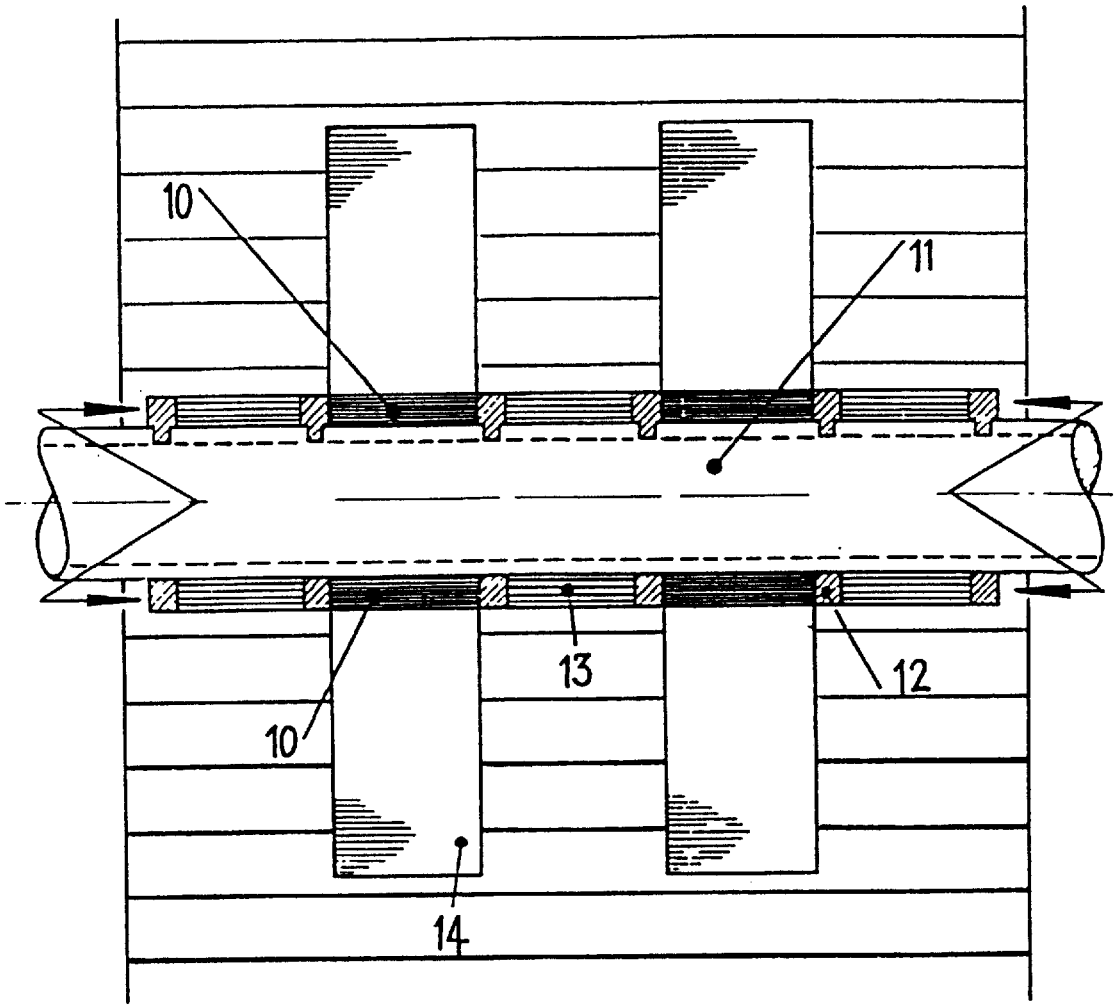
FIG. 1, as mentioned above, shows a traditional form of differential rewinding apparatus.
Figure 2:
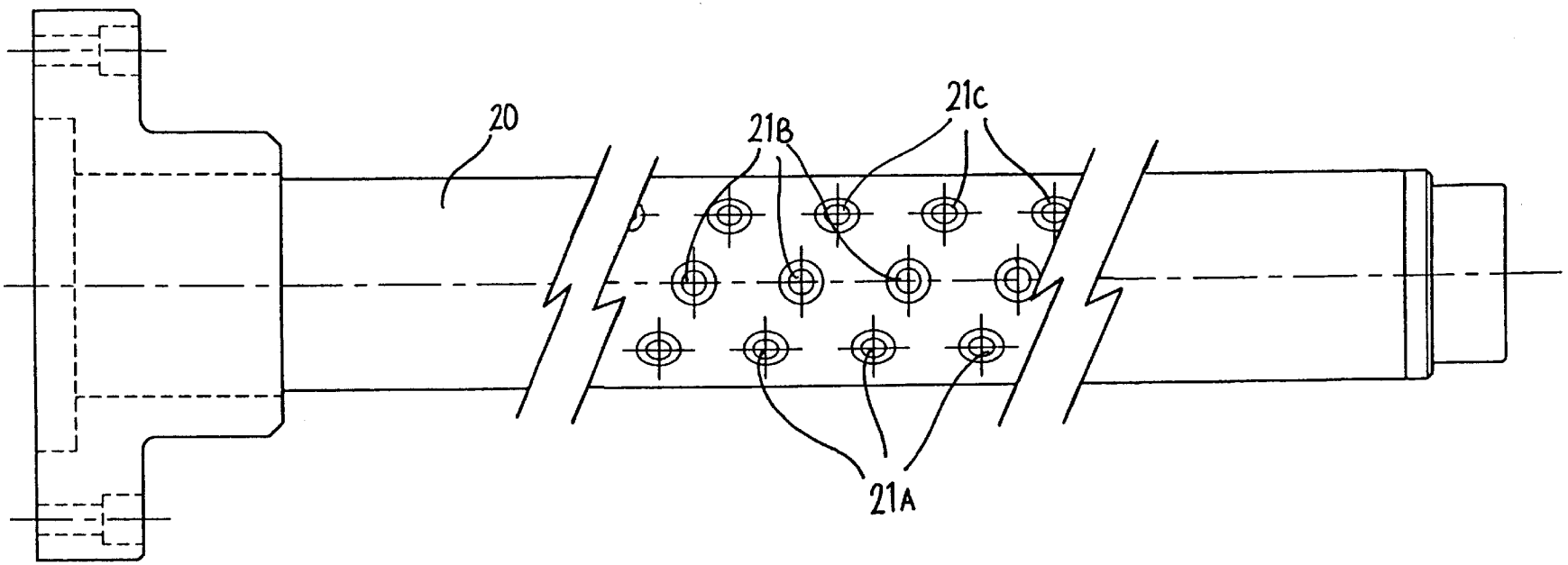
FIG. 2 is a partly broken away plan view of a differential rewind shaft assembly in accordance with the present invention.
Figure 3:
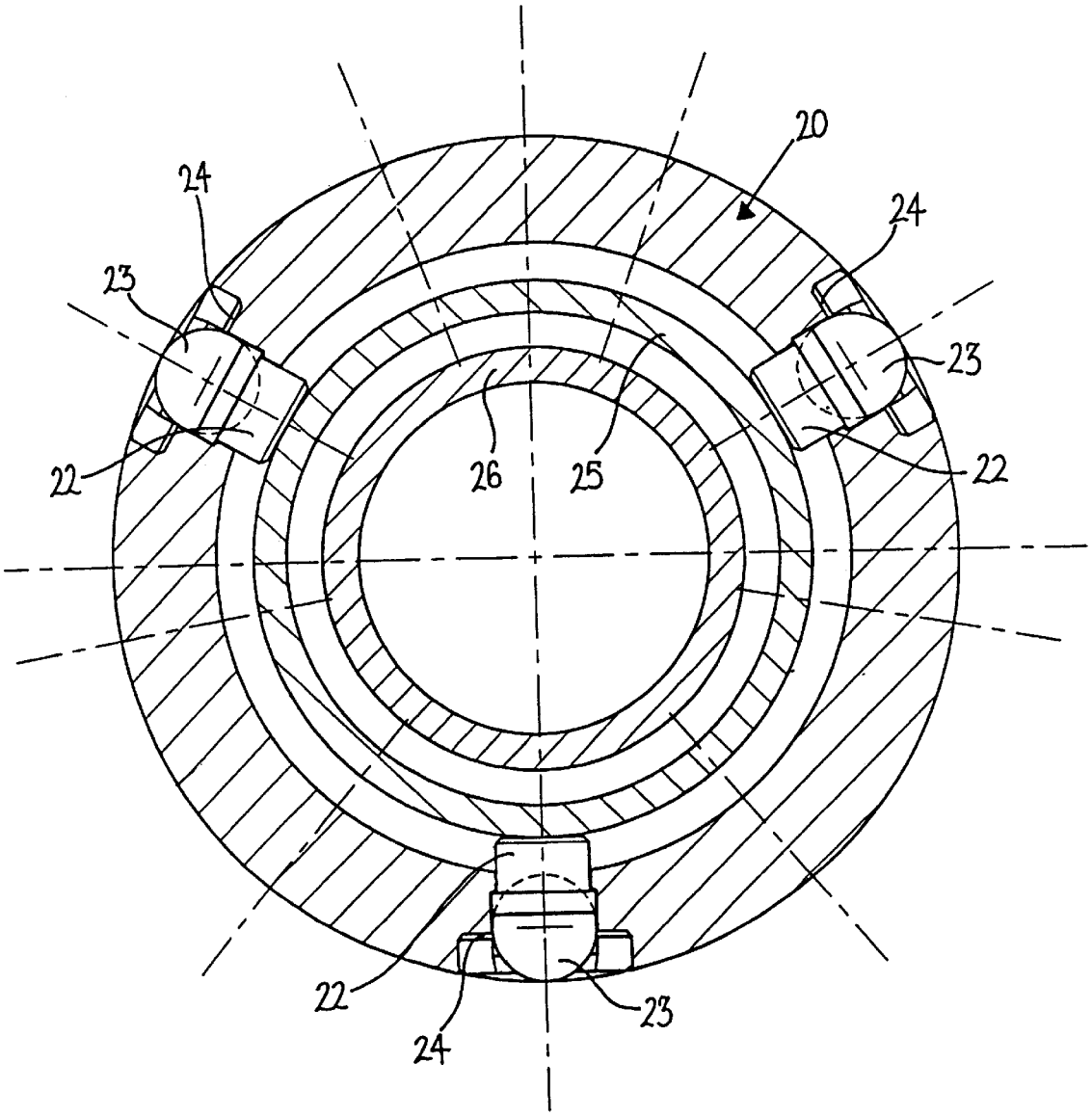
FIG. 3 is a transverse sectional view of the shaft assembly of FIG. 2.
Figure 4:
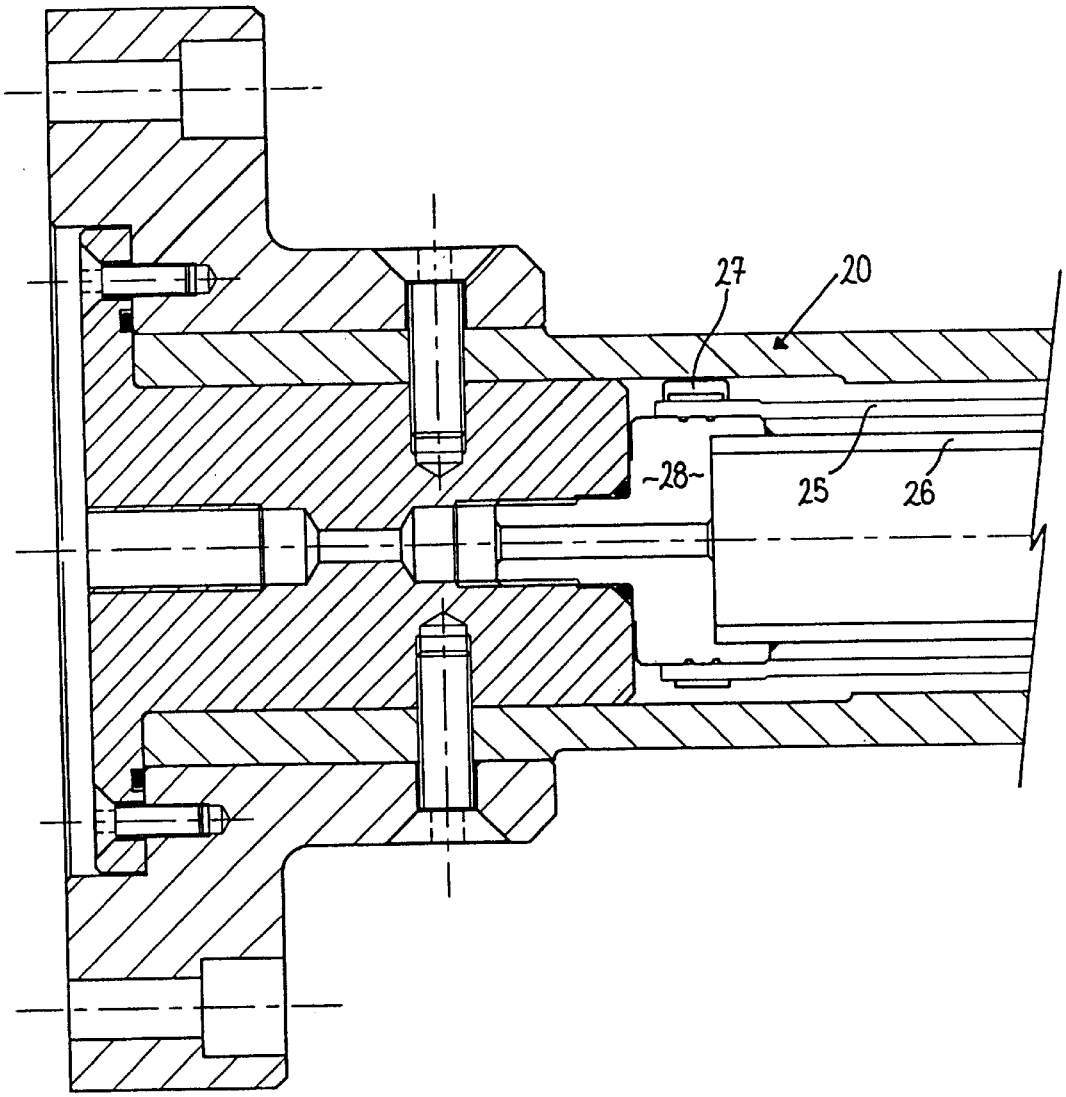
FIG. 4 is a longitudinal sectional view of one end of the shaft assembly of FIG. 2.
Figure 5:
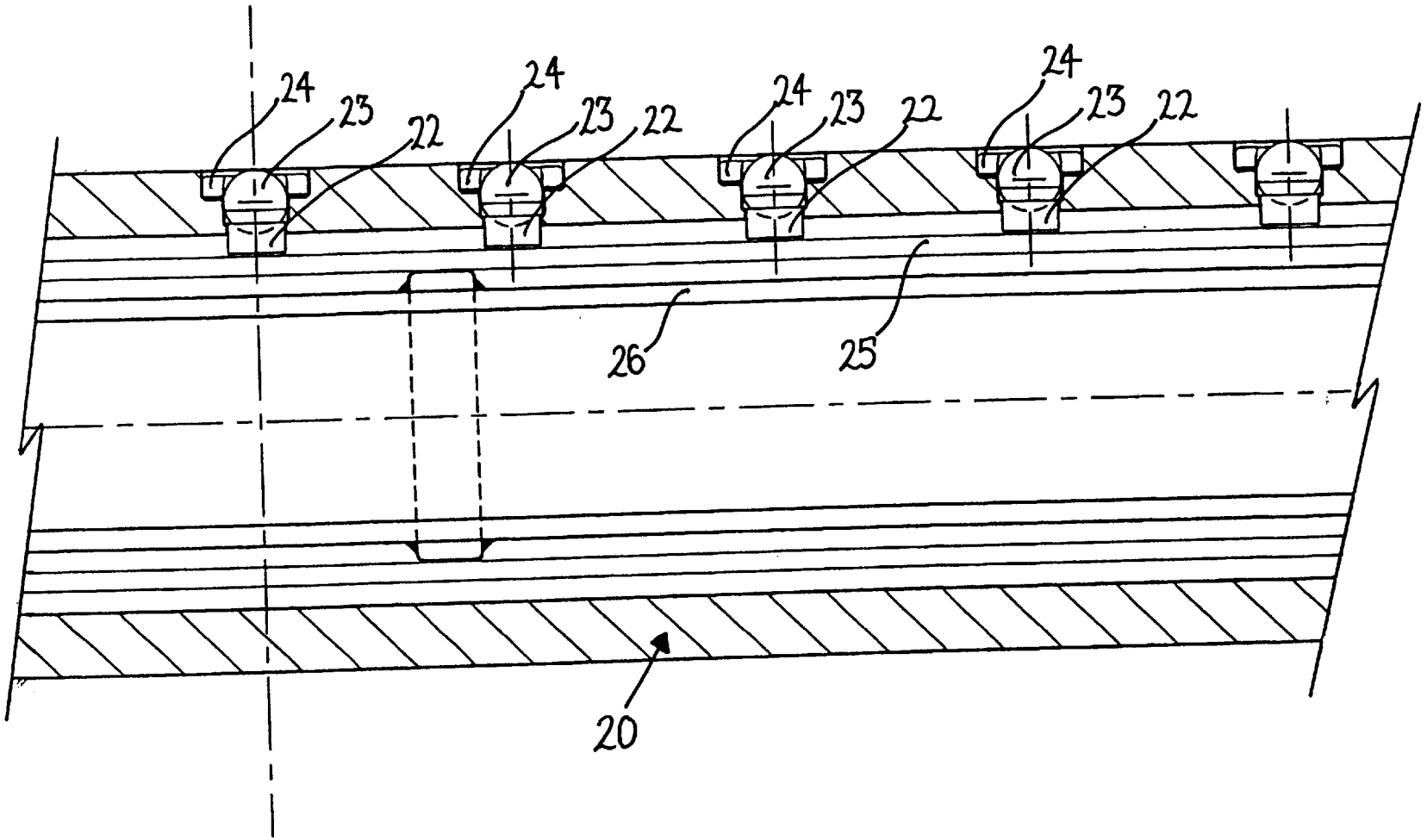
FIG. 5 is a longitudinal sectional view of an intermediate portion of the shaft assembly of FIG. 2.
Figure 6:
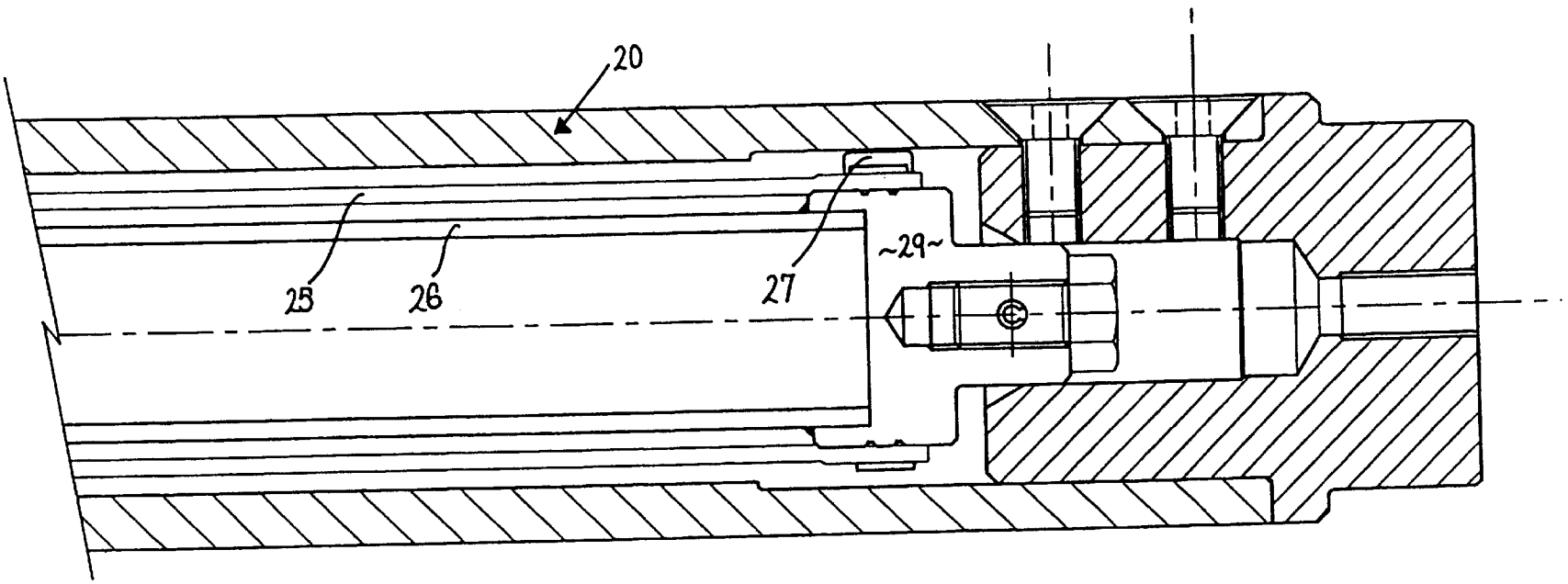
FIG. 6 is a longitudinal sectional view of the other end of the shaft assembly of FIG. 2.

The shaft assembly shown in FIGS. 2 to 6 includes a high quality steel tube 20 which is turned to a diameter of 0.8 mm. less than the internal diameters of the cores onto which the rolls of paper or other flexible materials are to be rewound. A large number of apertures 21 are machined in the steel tube 20, the apertures 21 being arranged in the form of a three-start helix so that, as shown in FIG. 2, there is a repeated pattern comprising three apertures 21A spaced apart 120° contained in a first common plane, three apertures 21B in a second common plane offset 40° from the apertures 21A in the first common plane, and three apertures 21C in a third common plane offset 40° from the apertures 21B in the second common plane.

Each of the apertures 21 is counterbored and, in the completed assembly, each aperture 21 contains a steel support cup 22, a ceramic ball 23 and a brass retaining ring 24, all of which are fitted from the outside of the shaft assembly.

A rubber bladder or sleeve 25 mounted on a tubular steel cartridge 26 is mounted within the bore of the steel tube 20. the rubber bladder 25 being attached to the steel cartridge 26 by means of hose clips 27. The cartridge 26 is secured at its ends to mounting elements 28 and 29 fixed to the steel tube 20 so that the steel cartridge 25 and the rubber bladder 25 will rotate in unison with the steel tube 20.

A compressed air supply (not shown) is connected to the shaft assembly through a rotary union and into one end of the shaft assembly expanding the rubber bladder 25 so as to cause the ceramic balls 23 to protrude through the retaining rings 24 and against the inside surfaces of the cardboard rewind cores (not shown).

The steel support cups 22 transmit the force exerted by the bladder 25 to the balls 23. The coefficient of sliding friction between the ceramic material and steel is lower than that between the ceramic material and cardboard The balls 23 will thus slide preferentially relative to the steel support cups 22 and will rotate against the inside surfaces of the cores.

The higher the air pressure within the rubber bladder 25, the greater the frictional forces acting between the steel cups 22 and the ceramic balls 23 which, in turn, increases the torque transmitted to the individual cores. The total torque transmitted to a particular core will depend on the number of balls 23 which it engages, i.e. on the width of the core.

The rotational speed of the shaft assembly is greater than that of the rewind cores causing them to slip around the tube 20. The action of the balls 23 pressed against the inside surfaces of the cores causes small grooves to appear immediately around the bores of the cardboard cores. The ceramic balls 23 will be located in these small grooves preventing any axial displacement of the cardboard cores relative to the shaft assembly and guaranteeing a good edge profile on the rewinding reels.

The shaft assembly is such that spacers between the cores are not required and it can accommodate any slit widths without resetting. The use of the shaft assembly and the method of differential rewinding of the present invention will therefore decrease the machine downtime by up to 30%, and possibly more, while improving the shaft strength and dramatically improving the reel quality.

Figure 7:
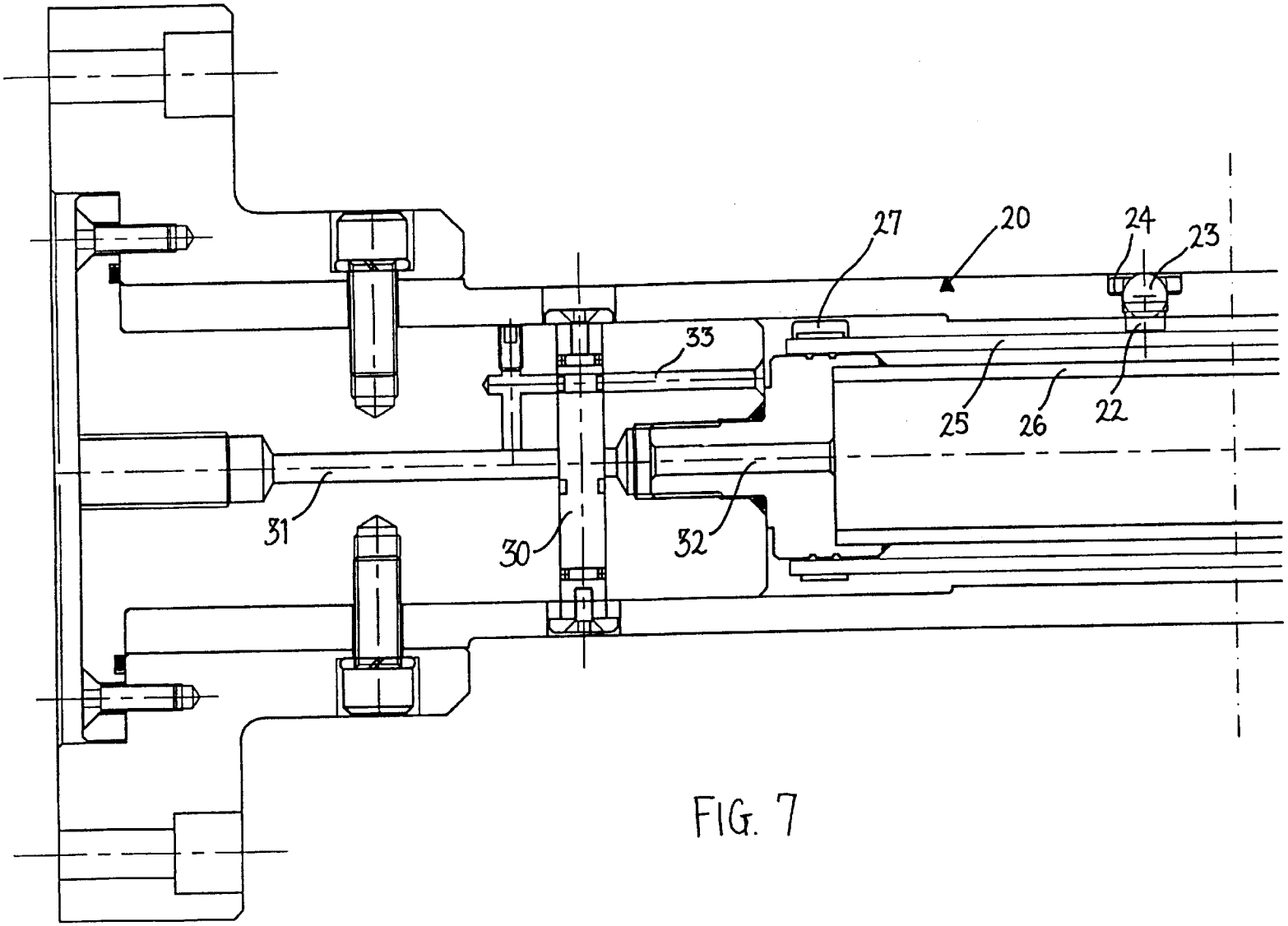
FIG. 7 is a view corresponding to FIG. 4 but showing an alternative form of differential rewind shaft fitted with a cleaning assembly.

Turning next to FIG. 7, this shows the apparatus of FIGS. 2 to 6 fitted with a cleaning system. It includes a manual spool valve 30 at the end of the shaft assembly at which the supply of compressed air Is connected. The manual spool valve 30 is shown in FIG. 7 in its cleaning position but is normally in its running position displaced upwardly from that shown in FIG. 7.

When in its running positions the spool valve 30 provides communication between an inlet passage 31 and an air feed passage 32 connected to the interior of the bladder 25. When in its cleaning position, the spool valve 30 provides communication between the inlet passage 31 and an air feed passage 33 which communicates with the space between the steel tube 20 and the bladder 25.

The mode of operation of the system shown in FIG. 7 is as follows:

a) when the shaft assembly has finished running and is stationary the air is expelled from the bladder 25, b) the operator then pushes the spool valve 30 into the cleaning position, i.e. as shown In FIG. 7, and operates a push button on the control desk controlling the differential rewinding operation. This then supplies the inlet passage 31 with a pre-set cleaning pressure for a set amount of time, and c) the air passes into the air feed passage 33 and exits through the apertures 21, purging the balls 23 and cups 22 of dust and dirt.

The operator then removes the reels from the steel tube 20 and inserts the new cores on to the shaft. The set amount of time at cleaning pressure has finished and the operator switches the manual spool valve 30 back into the run position, ready for the next cycle.

It will be appreciated that this sequence of operations is tied in to the machine sequencing to ensure that, every time the shaft is unloaded and then loaded, the ceramic balls 23 and the stainless steel seats 24 are cleaned.

What is claimed is:

1. A differential rewinding apparatus comprising a shaft on which, in use, a plurality of cores are mounted, a plurality of apertures in the shaft, roller elements in the apertures and means for urging the roller elements outwardly into engagement with the cores, and in which each of the roller elements is arranged to act between a core and a torque-transfer element formed of a material which has a coefficient of sliding friction with the roller elements lower than the coefficient of sliding friction between the roller elements and the cores.

2. Apparatus as claimed in claim 1, for use with cores formed of a material selected from cardboard and plastic, in which the roller elements are ceramic balls.

3. Apparatus as claimed in claim 2, in which the torque-transfer elements are steel cups within which the ceramic balls are seated.

4. Apparatus as claimed in claim 3, which includes means for preventing the accumulation of dust between the ceramic balls and the steel cups.

5. Apparatus as claimed in claim 4, in which the means for preventing the accumulation of dust comprises means for causing a flow of air out through the apertures in the rewind shaft.

* * * * *